US006032820A

United States Patent [19]

Ladina et al.

[11] Patent Number: 6,032,820

[45] **Date of Patent: *Mar. 7, 2000**

[54] EASY-OPEN PROMOTION COMPARTMENT

[75] Inventors: Joseph Ladina, Marietta, Ga.; Wendell Willingham, Zionsville, Ind.; Ted Boehm, Crawfordsville, Ind.; David Cerny, Crawfordsville, Ind.; David Denman, Crawfordsville, Ind.; Daniel Denman, Rockville, Ind.

[73] Assignee: Alcoa Closure Systems International, Inc., Crawfordsville, Ind.

[ * ] Notice: This patent is subject to a terminal disclaimer.

[21] Appl. No.: 09/281,037

[22] Filed: Mar. 30, 1999

Related U.S. Application Data

[63] Continuation of application No. 08/882,395, Jul. 10, 1997, Pat. No. 5,915,585.

[51] Int. Cl.[7] ..... B65D 85/00

[52] U.S. Cl. ..... 220/522; 220/270; 215/254; 215/227; 206/217

[58] Field of Search ..... 220/521, 522, 220/523, 526, 212, 258, 265, 266, 270, 276; 215/6, 227, 228, 349, 350, 351, 253, 254; 206/217, 216

[56] References Cited

U.S. PATENT DOCUMENTS

| | | | |
|---|---|---|---|
| 4,636,328 | 1/1987 | Flynn et al. | 220/522 X |
| 5,056,681 | 10/1991 | Howes | 220/522 |
| 5,356,021 | 10/1994 | McBride et al. | 215/350 X |
| 5,439,103 | 8/1995 | Howes | 215/227 X |
| 5,749,460 | 5/1998 | Rice | 220/522 X |
| 5,806,707 | 9/1998 | Boehm et al. | 220/522 |
| 5,813,563 | 9/1998 | Boehm et al. | 220/522 |
| 5,819,976 | 10/1998 | Boehm et al. | 220/522 |

FOREIGN PATENT DOCUMENTS

| | | | |
|---|---|---|---|
| 252937 | 6/1926 | United Kingdom | 220/522 |

*Primary Examiner*—Nathan Newhouse
*Attorney, Agent, or Firm*—Rockey Milnamow & Katz Ltd.

[57] ABSTRACT

A closure includes a promotion piece holding container within a cap to be installed onto a container such as a bottle. The promotion piece receiving container includes a top flange captured by a lip of a seal installed within the cap. The promotion piece receiving container includes a frangible band extending circumferentially around a substantial circumference of the container. The container can include a bottom flange arranged for convenience gripping and removing of the container from the cap, and a pull tab attached to the frangible band to assist in removing the frangible band to open the container for removal of the promotion piece.

8 Claims, 6 Drawing Sheets

EASY-OPEN PROMOTION COMPARTMENT

This is a continuation of U.S. application Ser. No. 08/882,395, filed on Jul. 10, 1997, now U.S. Pat. No. 5,915,585.

TECHNICAL FIELD

The present invention relates generally to promotional closures for containers configured for use in connection with a sales promotion or game, and more particularly to a promotion-receiving compartment for a closure which is configured to facilitate easy-opening by consumers for removal of a promotional element from within the compartment.

BACKGROUND OF THE INVENTION

Promotions and games which are associated with the sale of products have shown enduring popularity with consumers. A wide variety of such promotions and games are known, and may include gaming systems where game elements are collected to receive an award, or receipt by a consumer of a promotional element which can be redeemed for an award, or which may have intrinsic value for the consumer.

Promotional systems for use with container closures have heretofore taken various forms. For example, it has been known to provide the liner portion of a closure in the form of a gaming piece, whereby collection of certain ones of the liners permits prize redemption, or the liners themselves can be individually redeemed for cash or other awards. It has also been known to provide container closures with a compartment element positionable generally within the closure so that a promotional element can be positioned within the compartment for removal upon opening of the container. Closure/compartment arrangements of this nature are disclosed in U.S. Pat. No. 5,056,659, to Howes et al., hereby incorporated by reference.

The present invention is directed to an easy-open promotion-receiving member for a promotional closure which is configured to facilitate convenient manipulation and opening by consumers for use in a promotional or gaming system.

SUMMARY OF THE INVENTION

A promotional closure with which the present invention is particularly suited for use includes an outer plastic closure cap having a circular top wall portion and a depending annular skirt portion. The closure is adapted for application to an associated container, typically by the provision of interengaging threads. In accordance with the present invention, the promotion-receiving member of the closure includes a cup-shaped promotion compartment positionable generally beneath the top wall portion of the outer closure cap. Notably, the promotion compartment includes a frangible side wall strip. A promotional element positioned within the compartment can be easily removed as the side wall strip is at least partially separated from the side wall portion of the compartment to gain access into the compartment, all of which can be accomplished without resort to tools or other implements.

As noted, the promotion compartment of the present invention is positionable beneath the top wall portion of the outer closure cap, and inwardly of the annular skirt portion of the cap for disposition generally within an associated container. The cup-shaped promotion compartment includes a circular bottom wall, and an upstanding, generally cylindrical side wall extending upwardly therefrom. In the preferred form, the compartment includes an annular flange extending outwardly from the side wall. The cap includes a seal covering an inside of the top wall thereof and having an annular radially inwardly extending flange or lip. The annular flange of the compartment is captured between the top wall and the lip to be held within the cap. When the cap is removed from the bottle, the compartment can be removed from the cap by manipulating the compartment to cause the flange to disengage from the lip.

In accordance with the illustrated embodiment, the side wall of the compartment comprises a frangible portion which can be opened after the closure is removed from the associated container and the promotion compartment is removed from within the closure cap. Opening of the frangible portion of the compartment facilitates removal of a promotional element, such as a coupon, currency, or other promotional item, from within the promotion compartment.

In the preferred form, the frangible portion of the side wall comprises a side wall with a circumferentially extending band which extends at least partially about the circumference of the side wall and is defined by tear lines of weakened side wall, e.g., molded relatively thin wall sections, score lines, perforations, etc. Fracture along the weakened lines permits opening of the compartment such as by a hinging movement of the circular bottom wall about a remaining side wall portion which joins the bottom wall to the remainder of the compartment.

The annular flange acts in the nature of a finger grip to facilitate opening of the compartment. Also, in some embodiments, a bottom flange is also included which provides a finger grip for removing the compartment from the cap and for manipulating the compartment during opening thereof. The bottom flange also protects the pull tab affixed to the frangible portion during handling, assembly, and high speed application of closures to containers. The promotion compartment is thus split or opened circumferentially from its cup-shaped configuration, facilitating convenient access to a promotional element carried within the compartment.

A preferred fabrication of the compartment from low density polyethylene further facilitates convenient opening of the compartment.

The promotional closure embodying the principles of the present invention thus provides a method for accessing a prize or like promotional piece from a bottle. The method comprises the steps of removing a closure from the associated bottle, and thereafter removing a prize-container compartment from within the closure. The prize is accessed from within the compartment by tearing open the compartment by at least partially separating a frangible portion of the compartment, which extends at least partially circumferentially of the compartment. By this opening of the compartment, the prize can thereafter be accessed by removing the prize from within the compartment.

Other features and advantages of the present invention will become readily apparent from the following detailed description, the accompanying drawings, and the appended claims.

DETAILED DESCRIPTION

Figure 1:
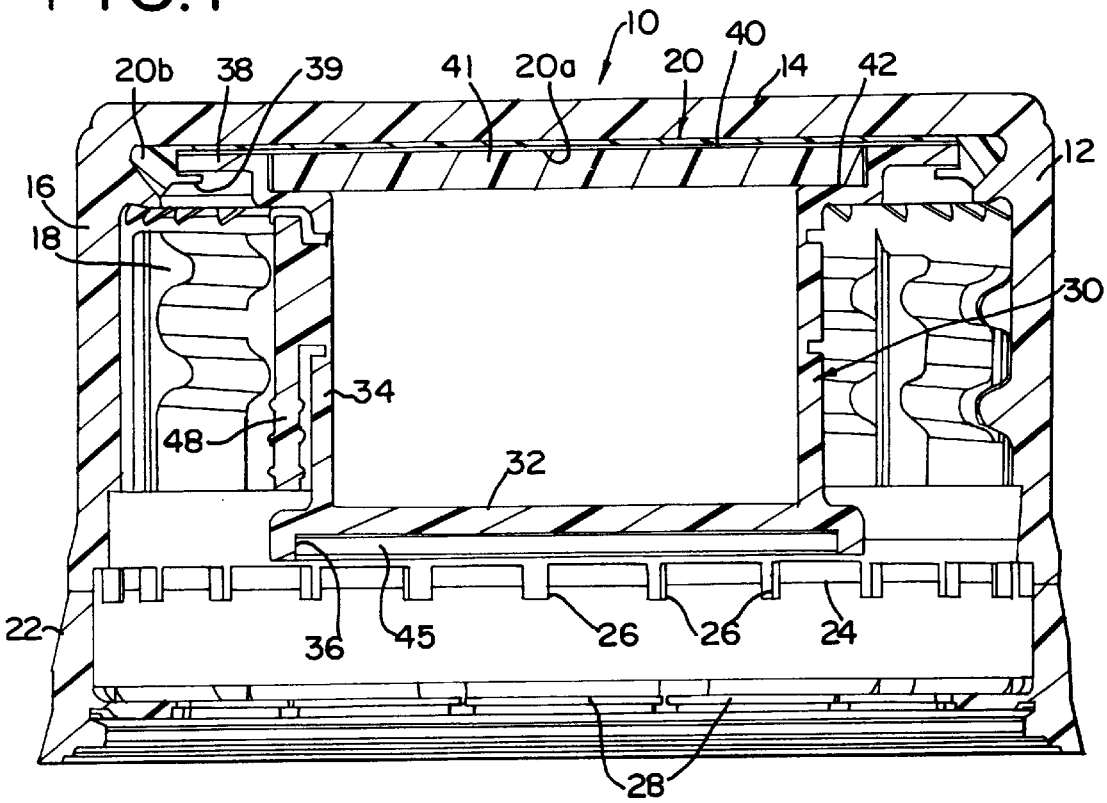
FIG. 1 is a cross-sectional view of a promotional closure having an easy-open promotion-receiving member embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

Figure 1A:
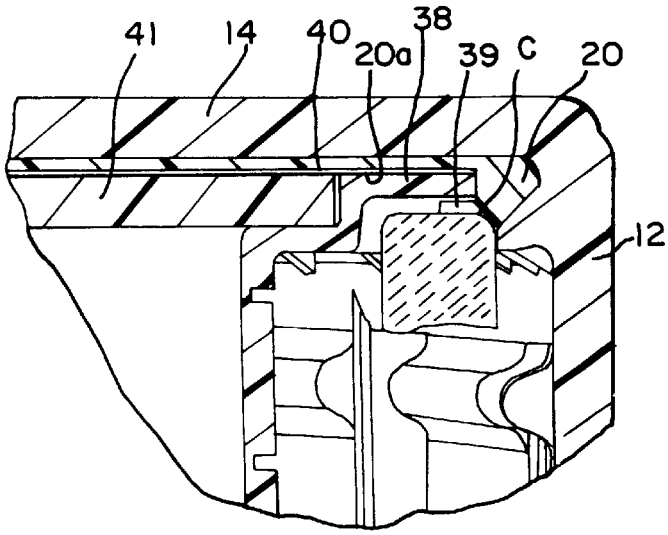
FIG. 1*a* is an enlarged cross-sectional view of a portion of the closure of FIG. 1.

With reference first to FIG. 1, therein is illustrated a promotional closure 10 including an easy-open promotion-receiving member embodying the principles of the present invention. Promotional closure 10 is particularly configured for use with an associated container, a portion of which is illustrated and is designated C shown in FIG. 1*a*. The container, such as a bottle, can be closed by the closure such as by threaded application to a neck portion of the container. Closures of the type illustrated in FIG. 1 can be formed in accordance with the teachings of U.S. Pat. No. 4,497,795, hereby incorporated by reference.

Closure 10 is in the form of an assembly that includes a molded plastic outer closure cap 12 having a circular top wall portion 14 and a depending annular skirt portion 16. The annular skirt portion 16 includes an internal helical thread formation 18 configured for cooperating threaded engagement with the associated container C. A sealing liner 20 positioned adjacent the top wall portion 14 of the closure facilitates sealing engagement of the closure with an associated container, and permits the closure to be configured for use with containers having carbonated contents.

The illustrated closure 10 is of the so-called tamper-indicating type, and includes a detachable pilfer band 22 depending from the annular skirt portion 16. The pilfer band 22 is distinguished from the upper closure cap 12 by a circumferentially extending score line 24, with a plurality of circumferentially spaced frangible ribs 26 extending between the inside surfaces of the closure cap and the pilfer band. A plurality of circumferentially spaced container-engaging flexible projections 28 extend inwardly of the pilfer band, for cooperating engagement with the locking portion of the associated container. By such cooperating engagement, the frangible ribs 26 split and fracture during removal of the closure from the container, thereby separating the pilfer band from the skirt portion 16 of the closure cap for the desired tamper-evidence. The illustrated embodiment of the pilfer band is configured in accordance with U.S. Pat. No. 4,938,370, hereby incorporated by reference, but may alternately be configured in accordance with the teachings of U.S. Pat. No. 4,418,828, hereby incorporated by reference.

Figure 2:
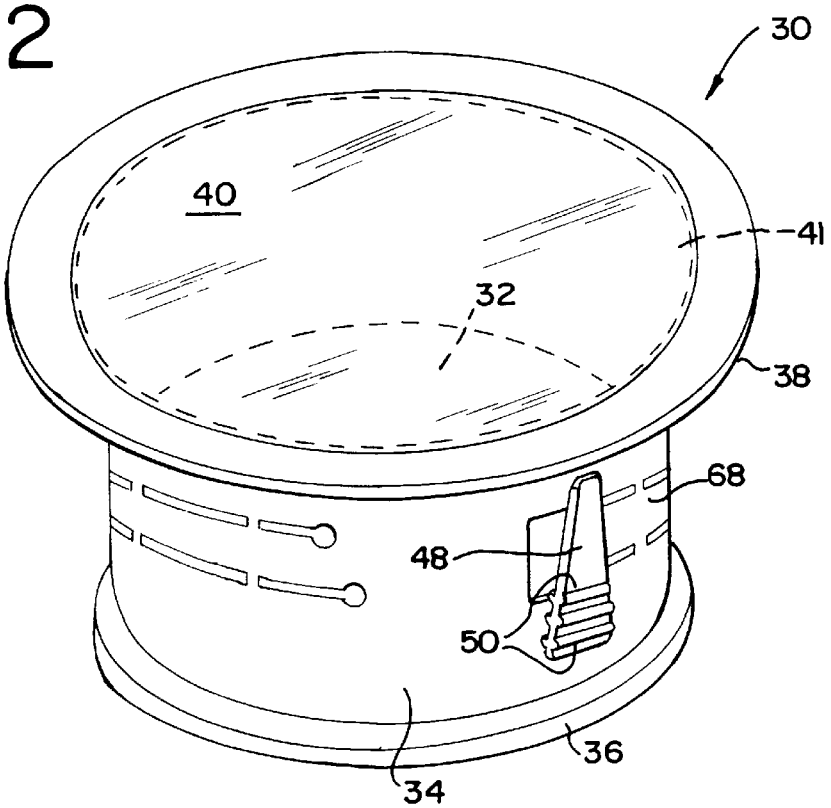
FIG. 2 is a top perspective view of the promotion-receiving member of the present invention.
Figure 3:
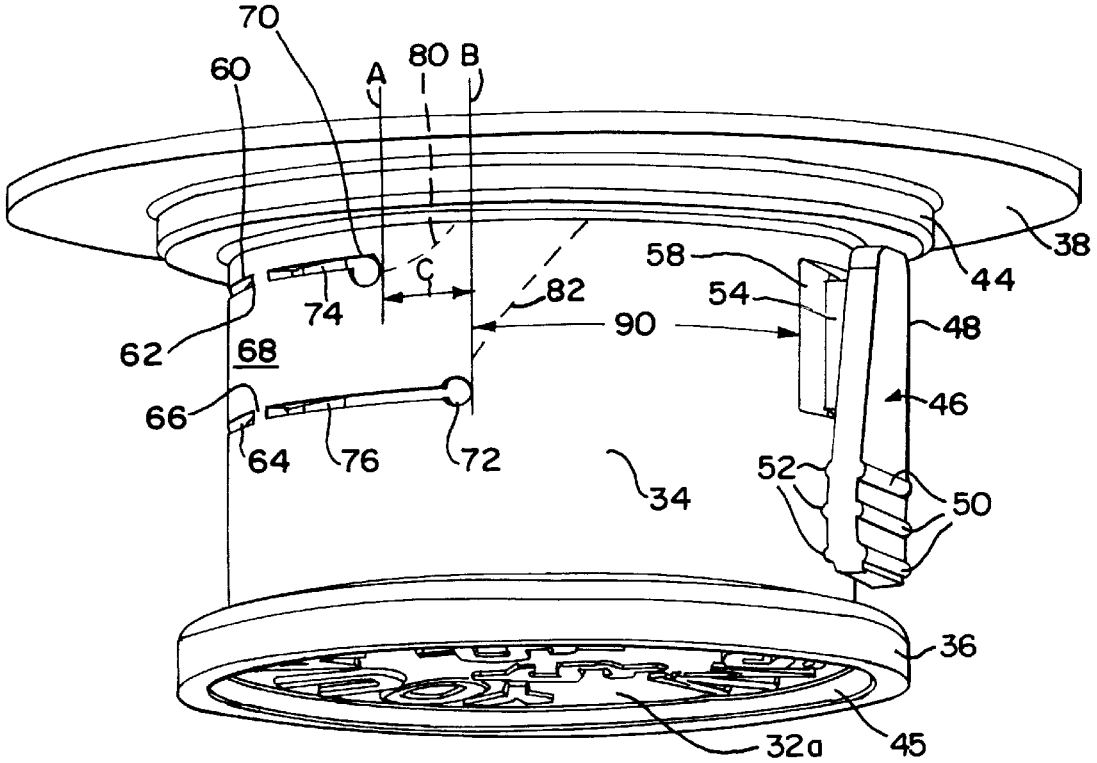
FIG. 3 is a bottom perspective view of the promotion-receiving member of the present invention.
Figure 4:
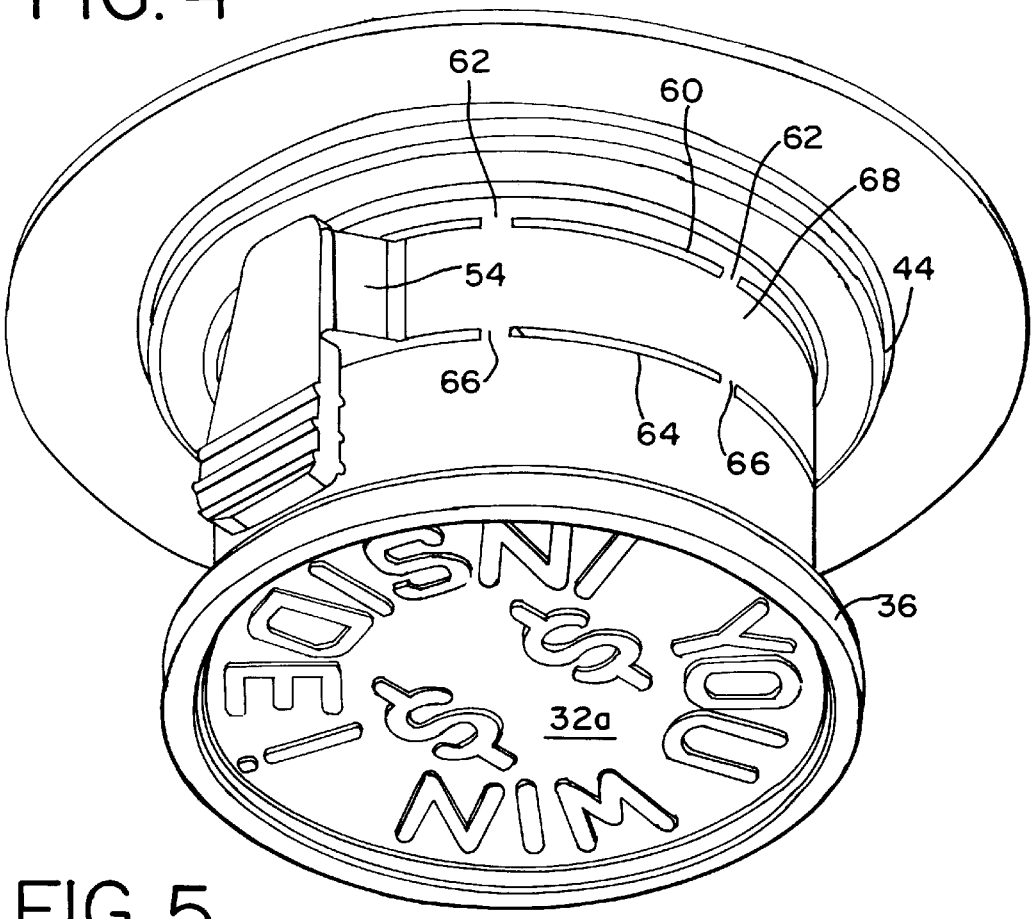
FIG. 4 is a bottom perspective view of the promotion-receiving member of FIG. 3 from a different viewing angle.

The closure 10 is intended for use in connection with consumer promotions or games, and to this end, the closure includes a promotion-receiving member positioned generally within the closure cap 12. As illustrated in FIGS. 2 through 4, the promotion-receiving member is provided in the form of a promotion compartment 30 having a generally cup-shaped configuration including a circular bottom wall 32, and a generally cylindrical upstanding side wall 34 extending upwardly from the bottom wall 32. In the preferred form, the promotion compartment 30 includes a depending annular bottom flange 36 which facilitates finger grasping for removal of the compartment from within the closure cap 12. The bottom flange 36 also desirably protects the pull tab (as will be described) of the compartment 30.

The compartment 30 is preferably of unitary construction apart from its cover member, and preferably molded from low density polyethylene plastic material which, as will be further described, facilitates tearing, opening, or splitting of the compartment so that a promotional element positioned within the compartment can be easily removed by consumers. Positioning of the compartment 30 within the closure cap 12 is facilitated by the provision of an annular compartment flange 38 which extends generally outwardly from the upper edge of the side wall 34. The annular compartment flange 38 is interengaged with a portion of the sealing liner 20 of closure 10, by the provision of an annular liner flange or lip 39 on the liner which fits between the container C and the compartment flange 38. The flange 39 extends from an annular liner bead 20*b*. As will be observed in FIGS. 1A and 2, the compartment flange 38 is preferably held in generally captive relationship between the liner flange 39 and the liner bead 20*b* within closure cap 12.

However, a closure prize compartment embodying the principles of the present invention can be otherwise retained within the associated outer closure cap. The closure assembly can be configured such that the upper annular flange 38 of the compartment effects sealing engagement with the associated container, with the closure liner 20 having no lip 39 or the like. In such an arrangement, a preformed disc liner can be provided in the outer cap (rather than the illustrated molded in place liner 20) to provide a so-called secondary seal, that is, an arrangement for sealing the container after removal of the compartment 30 from within the outer cap. In such an alternative construction, the compartment may be configured for self-venting. Such venting can be desirable in view of the elevated gas pressure which can exist within the compartment from use of the closure assembly on a container having carbonated contents. Normal migration of gas pressure into the compartment occurs after application of the closure assembly to the container after filling. Attendant to closure removal, gas pressure is released from within the container, but the sealed compartment 30 remains slightly pressurized. If the compartment is not retained within the closure cap (such as by the provision of lip 36 on liner 20), self-venting of the gas pressure within the compartment avoids outward expansion of the compartment which expansion can result in inadvertent dislodgement of the compartment from within the cap. A self-venting compartment can be provided by configuring the seal of cover member 40 to delaminate or open in a predetermined fashion. A suitable self-venting seal arrangement is described in commonly assigned U.S. patent application Ser. No. 08/746,710, filed Nov. 15, 1996.

The installation of the compartment 30 into the cap 12 includes the bending of the compartment flange 38 upwardly into a cone shape for passing an outer edge of the compartment flange between the lip 39 and the liner bead 20*b*. The bending is done by a tool which then releases the compartment flange 38 allowing the compartment flange to snap back to its planar configuration fully inserted between the lip 39 and the bead 20*b*.

FIG. 1 also illustrates that in the preferred form, the tab 48 extends radially outwardly no further than the bottom flange 36, and the top flange 38. This protects the tab 48 from damage during handling and assembly, and facilitates high-speed application of closures to containers.

A suitable promotional element (not shown) can be positioned within the interior of the compartment 30. Such a promotional element can be provided in the form of a coupon redeemable for an award or the like, folded currency (i.e., cash), or some other suitable promotional article. Retention of the promotional element within the compartment is desirably enhanced by the optional provision of a cover member 40 in the form of a membrane fitted to the flange 38, which cover member 40 can be provided in the form of a suitable plastic film or the like heat-sealed or otherwise secured to the flange 38 of the compartment. The cover 40 acts to desirably isolate the contents of the compartment from the contents of the associated container C, and to desirably enhance the structural integrity of the compartment 30 without impairing easy-opening of the compartment. The cover member can be a laminate of low density polyethylene with PET (polyethylene terephthalate) with a polyurethane bonding agent.

When the closure/container combination is used to contain carbonated beverages, the contents of the compartment 30 eventually become pressurized by the $CO_2$ within the container. When the closure is removed, the pressure inside the compartment has a tendency to "dome" or push out the film cover member 40 against the inside surface 20*a* of the seal 20. This can cause the compartment, particularly the compartment flange 38, to inadvertently release or "pop off" from above the liner flange 39. To prevent this occurrence, a substantially rigid reinforcing disc 41 is carried in a recessed annular step 42 (see FIG. 1) of the flange 38 and is sealed to the cover member 40. The disc 41 is sufficiently thick to substantially prevent "doming" which prevents pressing of a top of the cover member 40 to the inside surface 20*a*. The disc 41 is preferably composed of high density polyethylene. As an alternative arrangement the disc 41 can have a snap engagement to positively lock to the annular step 42. The disc can also be provided with a vent hole beneath the cover member for venting if the cover member is peeled off, or if a removable membrane-like cover member is contemplated.

One size of closure commonly used for containers for carbonated beverages has a diameter of 28 millimeters, with a promotion compartment embodying the principles of the present invention sized for disposition within an associated container when a closure of this size is applied thereto. While a promotion compartment in accordance with this invention can be configured for use with closures of many different sizes, use in connection with a 28 millimeter closure necessarily requires that the promotion compartment be relatively small in size. As such, removal of a promotional element from within the compartment should be as easy as possible to permit removal by consumers without resort to use of a tool or other implement.

Accordingly, the promotion compartment 30 in accordance with the present invention is configured for easy-opening, that is, is configured to split or open in a fashion which permits the contents of the compartment to be easily removed without the use of an associated implement. Thus, even when the promotion compartment 30 is sized for use with 28 millimeter closures, consumers can very easily gain access to the contents of the compartment.

As illustrated in FIGS. 3 and 4, the sidewall has an upper annular L-shaped (in cross-section) rim 44 which provides the stepped recess 42 for holding the disc 41. The depending annular bottom flange 36 is also L-shaped in cross-section, forming a bottom recess 45. The flange 36 can be used for finger gripping to remove the compartment from the cap. Within the bottom recess 45, an outer surface 32*a* of the bottom wall 32 is exposed. The outer surface 32*a* can carry indicia such as advertising, game information, or an announcement of a winning compartment, i.e., that the compartment contains a prize.

A handle or tab 46 is provided having an elongate body 48 with finger-gripping ribs 50 provided thereon on a front side and ribs 52 optionally provided on a back side. The elongate body 48 is connected to a pull portion 54 which is molded to a side wall region 58 having a reduced thickness. The pull portion 54 has a height in a direction parallel to an axis of the cylindrical wall 34. Two sets of intermittently weakened lines, preferably formed by molding relatively thin regions in the sidewall 34, are arranged in parallel around a partial circumference of the wall 34, spaced apart a distance approximating the height of the pull portion. The circumferentially extending tear lines preferably extend 270°–300° around the circumference, in substantially parallel relationship to each other.

A top weakened or tear line 60 has intermittent bridges or residual regions 62. A lower weakened or tear line 64 has residual regions 66. The upper and lower tear lines 60, 64 are spaced apart to define a frangible band-shaped portion 68 therebetween extending from the pull portion 54 around a partial circumference of the wall 34. The upper tear line 60 terminates in a first substantially circular recess 70 while the lower tear line 64 terminates in a second substantially circular recess 72. Additionally, a last region 74 of the tear line 60 which is contiguous with the recess 70, has a depth decreasing into the recess 70. Similarly, a last region 76 of the tear line 64 contiguous with the second recess 72 has a depth decreasing into the circular recess 72. The decreasing depth of the tear lines and the circular recesses tend to slow down and terminate ripping of the side wall at the recesses.

The first circular recess 70 terminates around the circumference of the wall 34 at a position A, while the second circular recess 72 extends further and terminates at the position B. The difference C between these two positions tends to cause the frangible portion 68, if ripped past the recesses 70, 72, to be removed along offset paths 80, 82 shown dashed, which are offset at an end region thereof toward the rim 44 rather than to continue across the side wall circumferentially. Thus, when the frangible portion 68 is forcibly removed, a region 90 substantially remains intact to retain the flange 38 connected to the wall 34 at this position. It should be noted that the residuals 62, 66 can be formed by relatively thick regions of the thinly molded tear lines 60, 64 or by using overlying bridge pieces similar to the bridge pieces 26 spanning across the score line 24 of the pilfer band.

Figure 5:
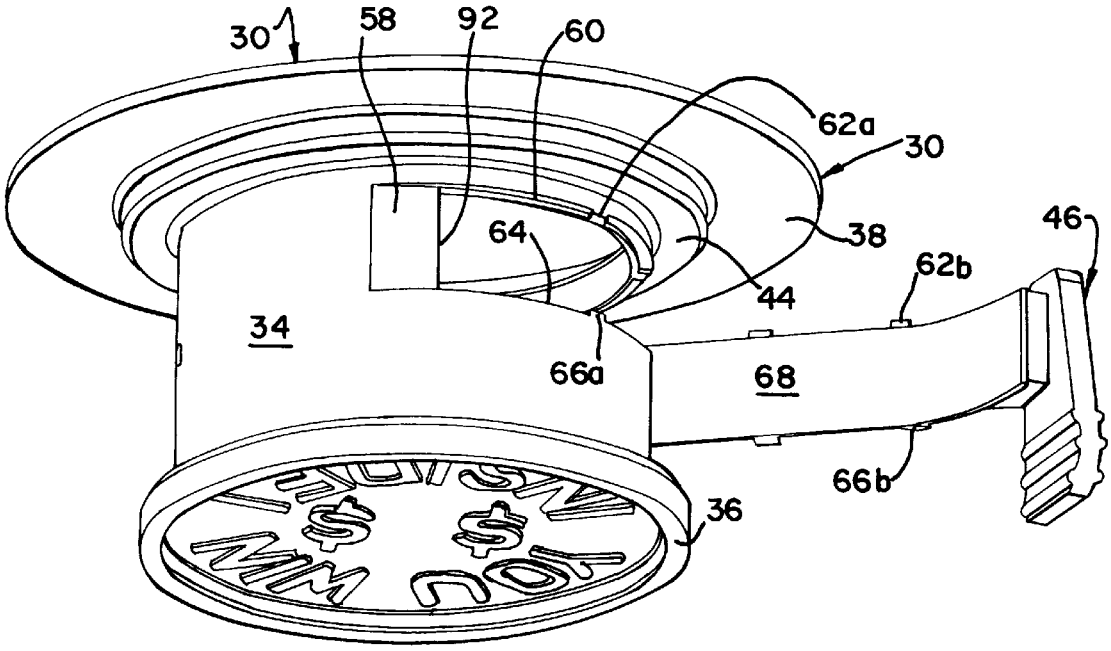
FIG. 5 is a bottom perspective view illustrating opening of the promotion-receiving member of the present invention.

FIG. 5 illustrates the promotion compartment 30 removed from the cap and in a partial stage of opening. The tab or handle 46 has been pulled from the region of reduced thickness 58 along a tear line 92 and the tear lines 60, 64. The residuals 62, 66 have been broken into half pieces or fragmentary pieces 62*a*, 62*b* and 66*a*, 66*b*. When the frangible portion or band 68 is sufficiently opened, the promotion piece held within the container 30 can be removed. If the frangible band-shaped portion 68 is continuously torn from the wall 34, the offset terminations A and B will cause an angular rip toward the flange 38 preventing a complete circumferential rip of the band and separation of the compartment 30 into top and bottom pieces. It is preferable to retain the entire opened compartment 30 as a single piece, or to allow only the band 68 to be removed while retaining the remainder of the container 30 as a single piece.

Figure 6:
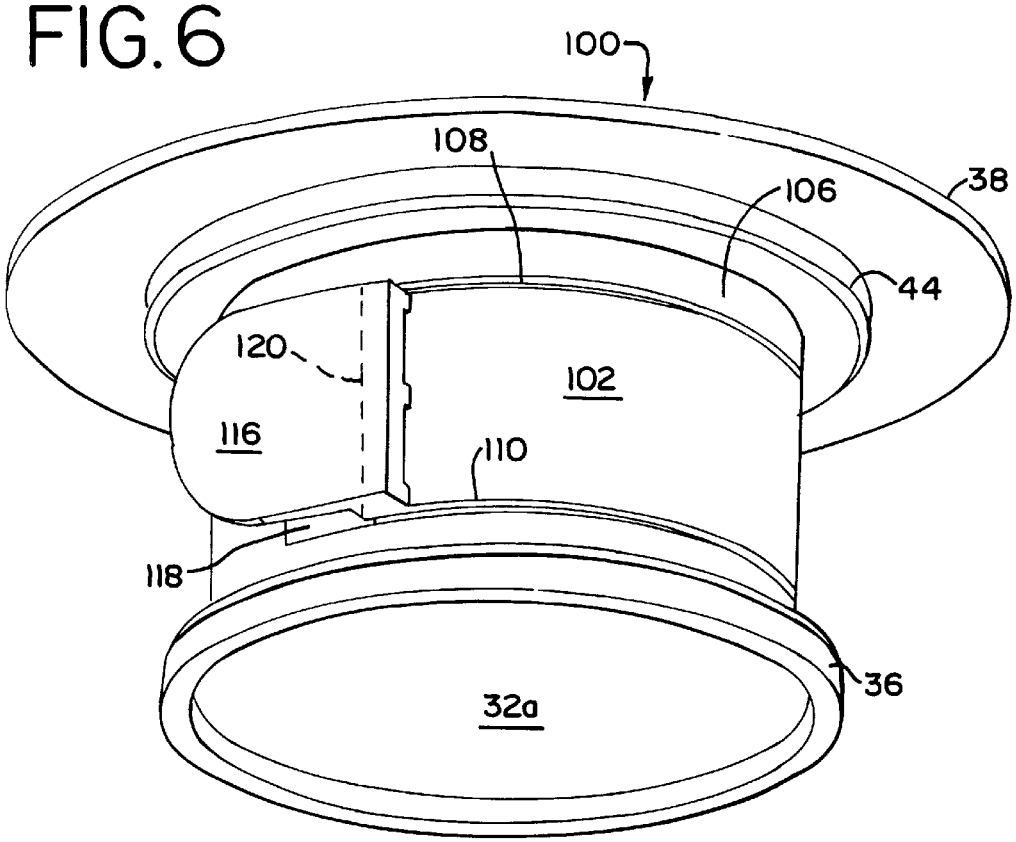
FIG. 6 is a bottom perspective view of an alternate promotion-receiving member of the present invention.
Figure 7:
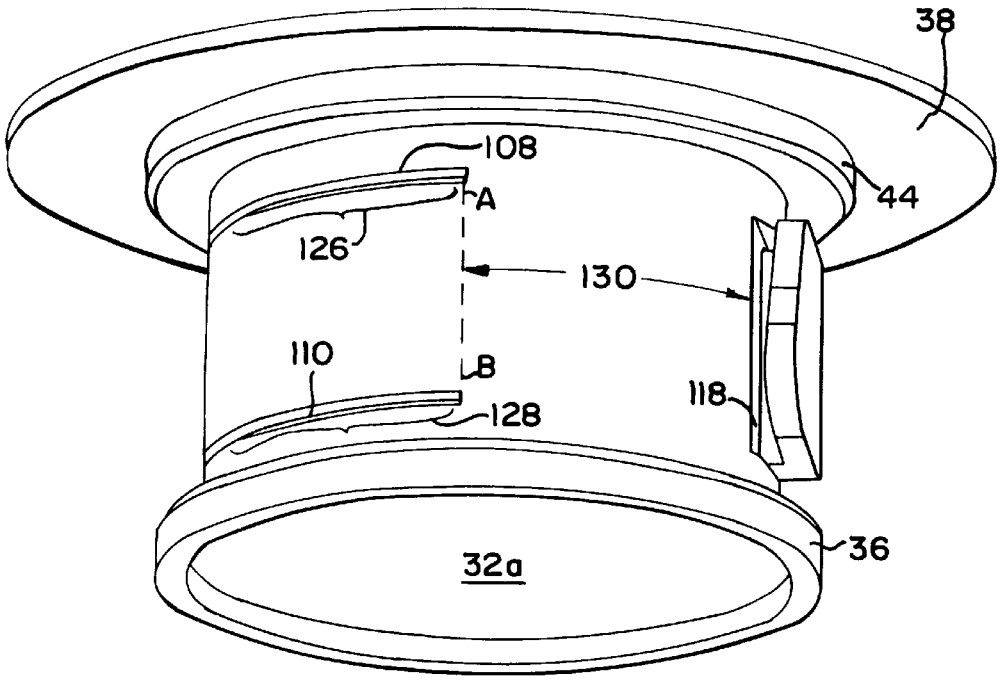
FIG. 7 is a bottom perspective view of the alternate promotion-receiving member of FIG. 6 from a different viewing angle.

FIGS. 6 and 7 illustrates an alternate embodiment promotion-receiving compartment 100 having a wide band 102 across its side wall 106 defined by two continuous tear lines 108, 110. A tangentially extending handle 116 connects to the band 102 at a rectangular depression 118 which form a reduced thickness wall region. When the handle 116 is forcibly pulled away from the wall 106, the vertical line 120 at the inner face between the handle 116 and the recess 118 separates and the band 102 can be peeled open along the tear lines 108, 110 circumferentially around the wall 106 to terminations A, B shown in FIG. 7. In this embodiment, no circular enlarged recesses are used at the termination positions A, B, and the termination positions are not offset circumferentially. However, the depth of the tear lines 108, 110 decreases gradually throughout the regions 126, 128 which are adjacent the terminal positions A, B. This decrease in depth at the terminal regions effectively slows the speed of peeling or tearing of the panel 102 from the wall 106 to prevent unwanted tearing throughout the wall region 130 between the terminal positions A, B and the recess 118.

Figure 8:
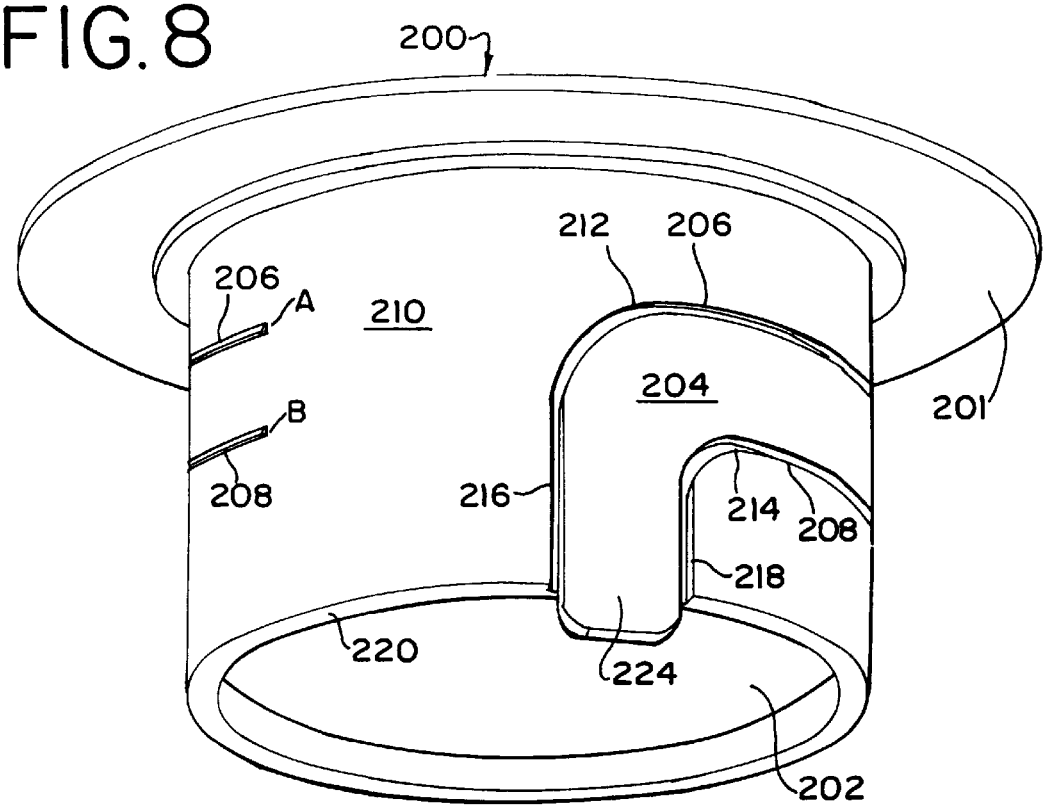
FIG. 8 is a bottom perspective view of a further alternate embodiment of the present invention.

FIG. 8 illustrates a further alternate promotion-receiving compartment 200. In this illustrated embodiment, stepped annular top and bottom flanges, as in the previous embodiments, are not used but optionally could be used. Instead, a reinforced planar annular flange 201 and a recessed bottom 202 are used. A frangible portion in the form of a band 204 is formed by a first tear line 206 and a second tear line 208 formed into an annular side wall 210 of the container 200. The tear lines 206, 208 extend substantially circumferentially around a portion of the circumference of the side wall 210 and turn down arcuately at positions 212, 214 into axially arranged tear line portions 216, 218 which extend to a bottom edge 220 of the wall 210. Additionally, an overhang portion 224 is provided contiguous with the band 204 and which extends outwardly of the edge 220 to provide a finger grip or pull tab. The tear lines 206, 208 wrap around the circumference of the wall 210 and terminate at positions A, B which can, for example, be configured and shaped as positions A, B shown in FIG. 7 with decreasing depth contiguous to the positions A, B; or configured and shaped as the terminations A, B shown in FIG. 3 with offset circular recesses and decreasing depth. Although no residuals are shown in the tear lines 206, 208 in the embodiment of FIG. 8, it is also possible to use residuals to strengthen the container.

Figure 9:
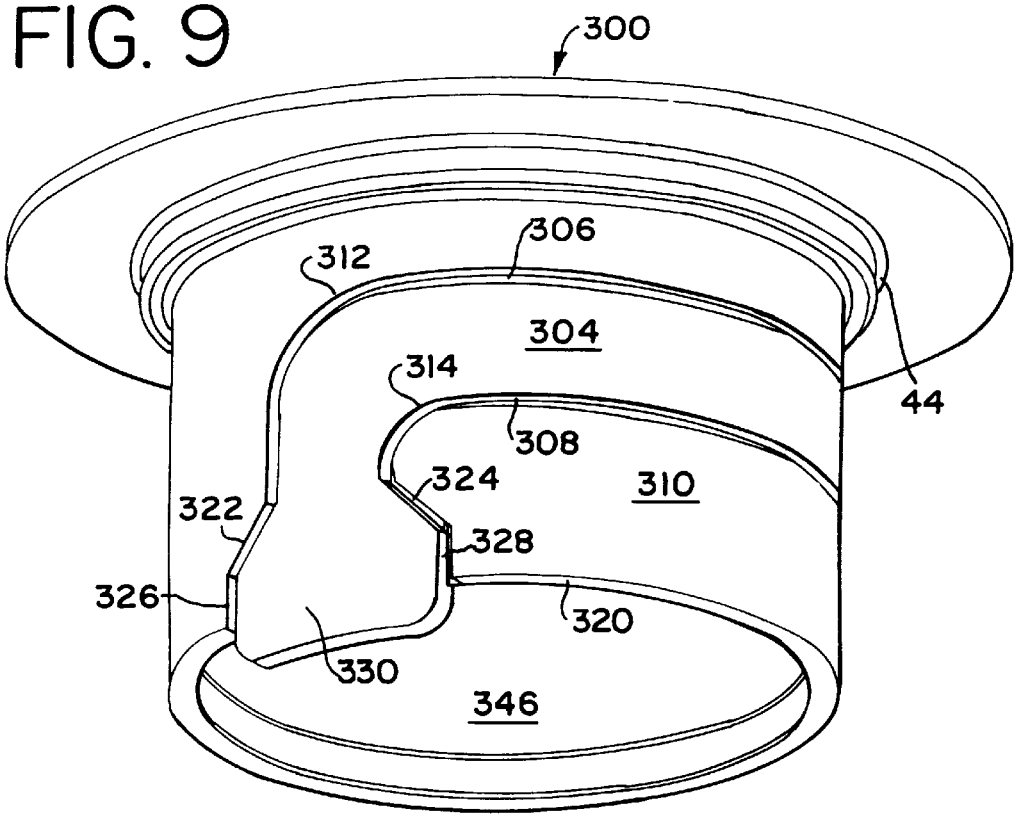
FIG. 9 is a bottom perspective view of a further alternate embodiment of the present invention.

FIG. 9 shows a still further alternate embodiment promotion-receiving compartment 300, somewhat similar to the compartment shown in FIG. 8. A frangible portion comprising band 304 defined by a first tear line 306 and a tear line 308 formed into an annular wall 310 of the container, extends circumferentially around the annular wall 310. At positions 312,314, the tear lines are arcuately turned down toward a bottom edge 320 of the wall 310. A recessed bottom wall 346 is provided. The tear lines 306, 308 extend downwardly into expanded tear lines 322, 324 diverging from each other. The tear lines 322, 324 then are turned downwardly into tear lines 326, 328 to the bottom edge 320 of the wall 310. The band 304 extends further outwardly of the bottom edge 320 with an overhanging portion 330. Thus, the overhanging portion 330 as well as the tear lines 322, 324, 326, 328 define a pull tab, easily gripped and manipulated for removing the band along the tear lines 326, 328, 322, 324, 306 and 304 around the partial circumference of the wall 310. The tear lines 306, 308 terminate at positions A, B, (not shown) in a fashion such as that shown in FIG. 3 or FIG. 7, or combination of the two methods. As with the other embodiments, residuals can be used optionally to increase the strength of the container 300, spaced intermittently along the tear lines.

Figure 10:
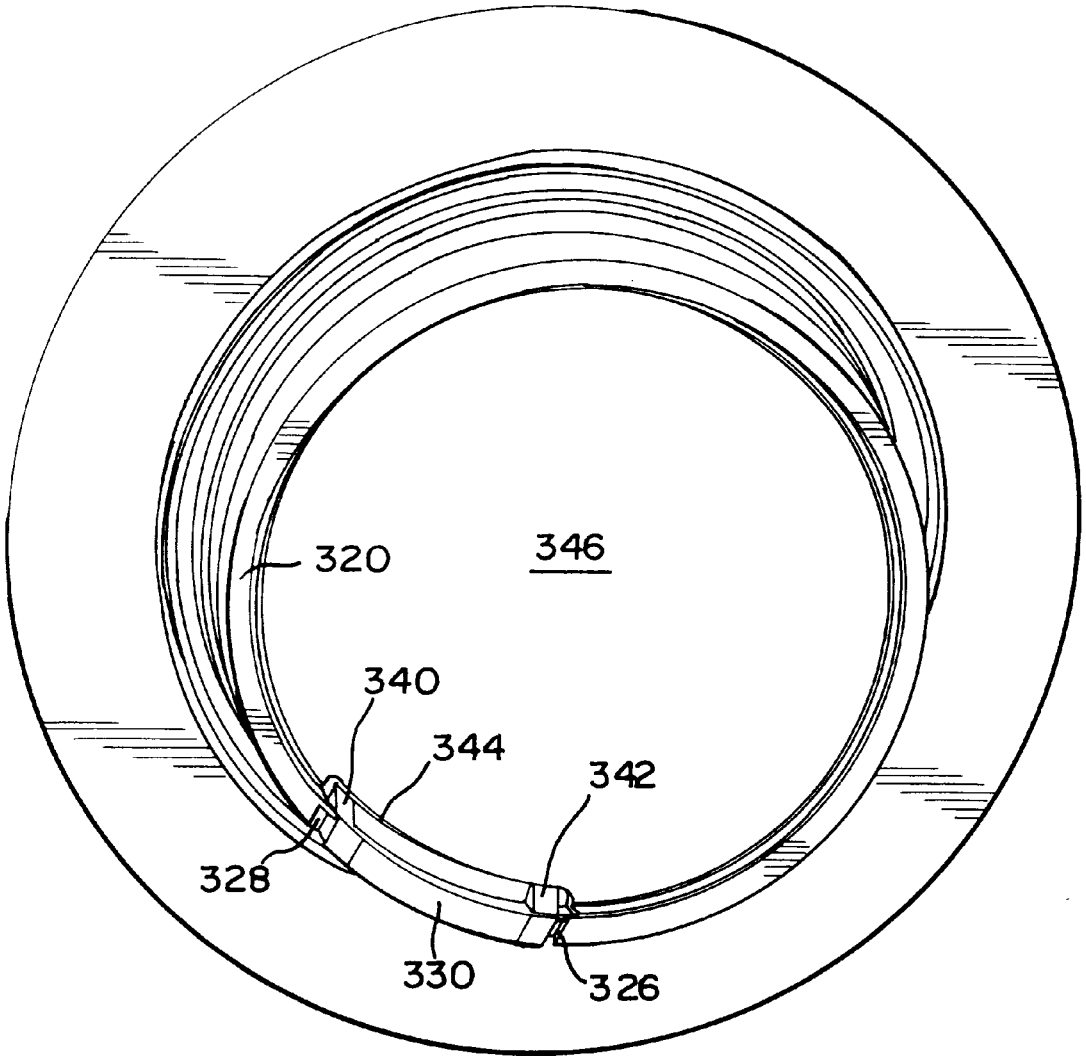
FIG. 10 is a bottom perspective view of the embodiment of FIG. 9 from a different viewing angle.

FIG. 10 illustrates in a bottom view the tab 330 having on a back side thereof reinforcing gussets 340, 342, which are molded into a recess region 344 of the bottom wall 346.

From the foregoing, it will be observed that numerous modifications and variations can be effected without departing from the spirit and scope of the novel concept of the present invention. It is to be understood that no limitation with respect to the specific embodiments disclosed herein is intended or should be inferred. The disclosure is intended to cover by the appended claims all such modifications as fall within the scope of the claim.

What is claimed is:

1. A closure assembly for a container comprising:

an outer closure cap having a top wall and a depending annular skirt including an internal thread formation for threaded engagement with said container; and a promotion compartment positionable generally within said closure cap, said compartment having a circular bottom wall, an upstanding generally cylindrical side wall extending therefrom to define a circumference, an annular upper flange extending outwardly from said side wall, said compartment being configured for disposition within said closure cap so that said upper flange is positioned generally between said top wall of said closure cap and said container for effecting sealing engagement with the container, said compartment being removable from within said closure cap after removal of said closure assembly from said container, said compartment including a frangible portion for opening said compartment comprising a band-shaped portion in said side wall defined by a pair of spaced apart, circumferentially extending tear lines extending at least partially about the circumference of said side wall, said frangible portion including a pull tab joined to said band-shaped portion for tearing said band-shaped portion along said tear lines.

2. A closure assembly in accordance with claims 1, wherein said compartment includes a frangible portion to facilitate opening of said compartment.

3. A closure assembly in accordance with claim 1, wherein said compartment includes a bottom flange depending from said circular bottom wall.

4. A closure assembly in accordance with claim 1, including a sealing liner positioned adjacent said top wall of said outer closure cap for sealing said container after removal of said compartment from said closure cap.

5. A closure assembly in accordance with claim 4, wherein said sealing liner comprises a preformed disc liner.

6. A closure assembly in accordance with claim 1, wherein said compartment includes cover means positioned adjacent said annular upper flange for closing the interior of said compartment.

7. A closure assembly in accordance with claim 6, wherein said cover means comprises a membrane-like cover member sealed to said annular flange.

8. A closure assembly in accordance with claim 6, wherein said cover means comprises a circular disc.

* * * * *